US006290262B1

(12) United States Patent
Petkovsek

(10) Patent No.: US 6,290,262 B1
(45) **Date of Patent: *Sep. 18, 2001**

(54) CONTINUOUS SPECIAL SERVICE LABELS AND A METHOD FOR PREPARING A MAILPIECE FOR DELIVERY BY SPECIAL SERVICE

(76) Inventor: Glenn Petkovsek, 2 Saverne Cir., Little Rock, AR (US) 72211

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 180 days.

(21) Appl. No.: 08/905,072

(22) Filed: Aug. 1, 1997

Related U.S. Application Data

(63) Continuation-in-part of application No. 08/725,856, filed on Oct. 4, 1996.

(51) Int. Cl.[7] ..... B42D 15/00

(52) U.S. Cl. ..... 283/81; 229/300; 283/79; 283/101; 428/40.1; 428/41.8; 428/43

(58) Field of Search ..... 283/80, 79, 116, 283/101, 105, 81; 229/300; 428/40.1, 41.8, 43

(56) References Cited

U.S. PATENT DOCUMENTS

| | | | | |
|---|---|---|---|---|
| 3,501,365 | * | 3/1970 | Marshall | 161/38 |
| 3,974,311 | * | 8/1976 | Cherrin | 428/43 |
| 4,061,808 | * | 12/1977 | Sato | 428/42 |
| 4,204,706 | * | 5/1980 | Blum et al. | 283/21 |
| 4,418,865 | | 12/1983 | Bowen . | |
| 4,491,334 | | 1/1985 | Dicker . | |
| 4,565,317 | | 1/1986 | Kranz . | |
| 4,682,793 | | 7/1987 | Walz . | |
| 4,925,716 | * | 5/1990 | Haas | 428/41 |
| 4,952,433 | * | 8/1990 | Tezuka et al. | 283/81 |
| 5,183,203 | * | 2/1993 | Sanders | 229/300 |
| 5,190,210 | * | 3/1993 | Walz | 283/81 |
| 5,413,383 | * | 5/1995 | Laurash et al. | 283/81 |
| 5,476,420 | | 12/1995 | Manning . | |
| 5,501,393 | * | 3/1996 | Walz | 229/300 |
| 5,507,526 | | 4/1996 | Petkovsek . | |
| 5,520,990 | * | 5/1996 | Rotermund | 283/81 |
| 5,573,277 | * | 11/1996 | Ptekovsek | 283/81 |
| 5,633,071 | * | 5/1997 | Murphy | 283/81 |
| 5,664,725 | * | 9/1997 | Walz | 229/300 |

FOREIGN PATENT DOCUMENTS

| | | | | |
|---|---|---|---|---|
| 259498 | * | 3/1988 | (EP) . | |
| 2143204 | * | 2/1985 | (GB) | 283/101 |

* cited by examiner

*Primary Examiner*—A. L. Wellington
*Assistant Examiner*—Monica Carter
(74) *Attorney, Agent, or Firm*—Patents+TMS, P.C.

(57) ABSTRACT

A continuous assembly of special service mailing labels and a method for preparing mailpieces requiring delivery by a special service are provided. The labels are adhesively secured to a backer and removable therefrom for application to a mailpiece. The labels include at least one area that may be printed, and a designation area that is distinct from a majority of the remainder of the label. The designation area identifies the type of special service required for the mailpiece to which the label is attached. In addition, the labels include a detachable auxiliary information portion which may serve as either a return address label or a customer receipt.

24 Claims, 2 Drawing Sheets

CONTINUOUS SPECIAL SERVICE LABELS AND A METHOD FOR PREPARING A MAILPIECE FOR DELIVERY BY SPECIAL SERVICE

BACKGROUND OF THE INVENTION

This application is a continuation-in-part application of U.S. patent application Ser. No. 08/725,856, filed on Oct. 4, 1996.

The present invention generally relates to continuously printed labels. More specifically, the present invention relates to pre-printed labels designating a special service delivery for a mailpiece on which the label is adhered following removal from a backer on which the labels are provided. In addition, the present invention relates to a method for preparing mailpieces requiring delivery by a special service.

It is, of course, generally known to provide labels on a backer. These labels are typically pre-printed; however, the labels are typically not capable of receiving printed, variable information thereon.

It is further generally known to deliver mailpieces that require special services. Such services include certified mail, return receipt for merchandise mail, registered mail, insured mail and the like. Preparation for special service mail is, however, complex. Currently, the Postal Service requires numerous forms to be completed and secured to the mailpiece prior to payment and delivery thereof. For example, for certified mail delivery, a receipt for certified mail is first completed. The form is often attached to a certified mail form that requires attachment to an envelope or mailpiece. Then, if return receipt is required, a separate return receipt postcard must be completed and separately attached to the envelope prior to delivery of the mailpiece.

Many situations exist in which a receipt for the certified mail and/or a return postcard are not necessary for a particular delivery. Further, article numbers printed identifying the mailpiece can be electronically stored rather than requiring a separate receipt identifying each article number. Therefore, an article number can be tracked without maintaining a separate receipt for each mailpiece.

Still further, in a batch of mailpieces requiring special service delivery, often only one or a few of the mailpieces may require that return receipt is provided. Therefore, providing a capability for identifying specific article numbers that require return receipt is beneficial for particular applications within a mailing.

A need, therefore, exists for an improved assembly that simplifies delivery and processing of special service mailing, particularly for large batches of mailing requiring identical special services for the mailpieces as well as a simplified method for preparing mailpieces for delivery by special service.

SUMMARY OF THE INVENTION

The present invention provides an assembly and a method for simplifying special service delivery of mailpieces. More specifically, the present invention provides labels attached to a backer wherein the labels identify the specific type of special service required for a mailpiece following removal of the label from the backer and subsequent attachment to the mailpiece.

To this end, in an embodiment of the present invention, a continuous assembly is provided which includes a plurality of labels adhesively connected to a backing sheet. Each of the labels includes a mailing portion which is detachably connected to an auxiliary portion.

In an embodiment, the mailing portion of the assembly includes a distinctly colored section.

In an embodiment, the mailing portion of the assembly further includes identifying information which is indicative of the special service required for the mailpiece.

In an embodiment, the mailing portion of the assembly also includes a printable area for printing an indicia thereon.

In an embodiment, the mailing portion of the assembly includes a first printable area for printing an indicia thereon and also a second printable area for printing special instructions wherein the first printable area is separated from the second printable area.

In an embodiment, the mailing portion includes a distinctly colored section which separates the first printable area from the second printable area.

In an embodiment, the assembly also includes a plurality of primary tear lines which extend through the backing sheet and which are aligned to separate adjacently positioned labels on the backing sheet.

In an embodiment, the assembly also includes a plurality of secondary tear lines which extend through both the backer and the labels and which are aligned to separate the mailing portions of a label from the associated auxiliary portions of the same label.

In another embodiment of the present invention, a method for preparing a mailpiece requiring delivery by a special service is provided. The method comprises the steps of: providing a backer; providing a plurality of labels adhesively attached to the backer wherein each of the labels has both a mailing portion and a detachably connected auxiliary portion; removing the mailing portion from the backer; and attaching the mailing portion to a corresponding mailpiece.

In an embodiment, the method further compromises the steps of: removing the auxiliary portion from the backer; and attaching the auxiliary portion to the corresponding mailpiece as an addressee address label.

In an embodiment, the method further comprises the steps of: removing the auxiliary portion from the backer; and attaching the auxiliary portion to the mailpiece as a return address label.

In an embodiment, the method further comprises the steps of: detaching the auxiliary portion, together with an associated portion of the backer to which the auxiliary portion is removably secured, from a remainder of the backer; and retaining the auxiliary portion for general mailing verification purposes.

In an embodiment, the method further comprises the step of: providing a plurality of tear lines in the backer to facilitate the detaching of the auxiliary portion.

In an embodiment, the method further comprises the steps of: providing a plurality of primary tear lines through the backer and aligned to separate adjacently positioned labels; and providing a plurality of secondary tear lines through both the backer and the labels which are aligned to separate the mailing portion from the auxiliary portion of the label.

In an embodiment, the method further comprises the step of: printing an identifier on the mailing portion which corresponds to the particular mailpiece.

In an embodiment, the method further comprises the step of: providing an area on the mailing portion which is distinctly colored from a remainder of the mailing portion.

In an embodiment, the method further comprises the step of: printing an indicia on a printable area on the mailing portion of the label.

In an embodiment, the method further comprises the steps of: printing an indicia on a first printable area of the mailing portion; and printing special instructions on a second printable area on the mailing portion of the label.

It is, therefore, an advantage of the present invention to provide mailing labels and a method for preparing mailing pieces that simplifies the same for mailpieces requiring delivery by a special service.

Another advantage of the present invention is to provide mailing labels and a method for preparing mailpieces using mailing labels that are simple to manufacture.

And, another advantage of the present invention is to provide mailing labels and a method for preparing mailpieces requiring delivery by a special service that are simple to use.

Yet another advantage of the present invention is to provide mailing labels and a method for preparing mailpieces requiring delivery by a special service that simplifies tracking of the mailpieces.

And, another advantage of the present invention is to provide mailing labels and a method for preparing mailpieces requiring delivery by a special service that are readily processed and applied to the mailpieces.

And, another advantage of the present invention is to provide mailing labels and a method for preparing mailpieces requiring delivery by a special service without additional processing steps.

Moreover, an advantage of the present invention is to provide mailing labels and a method for preparing mailpieces requiring delivery by a special service that is readily modifiable.

A further advantage of the present invention is to provide mailing labels and a method for preparing mailpieces requiring delivery by a special service which offer additional auxiliary information for use by the sender of the mailpiece in connection with the mailing of the mailpiece.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a continuous assembly of special service mailing labels and a method for preparing mailpieces requiring delivery by a special service. More specifically, the present invention provides a series of labels provided on a backer indicative of a special service required for delivery of the mailpiece. Each label is removable from the backer and may be placed on the mailpiece. The label may be separately printed while on the backer or after removal therefrom.

Figure 1:
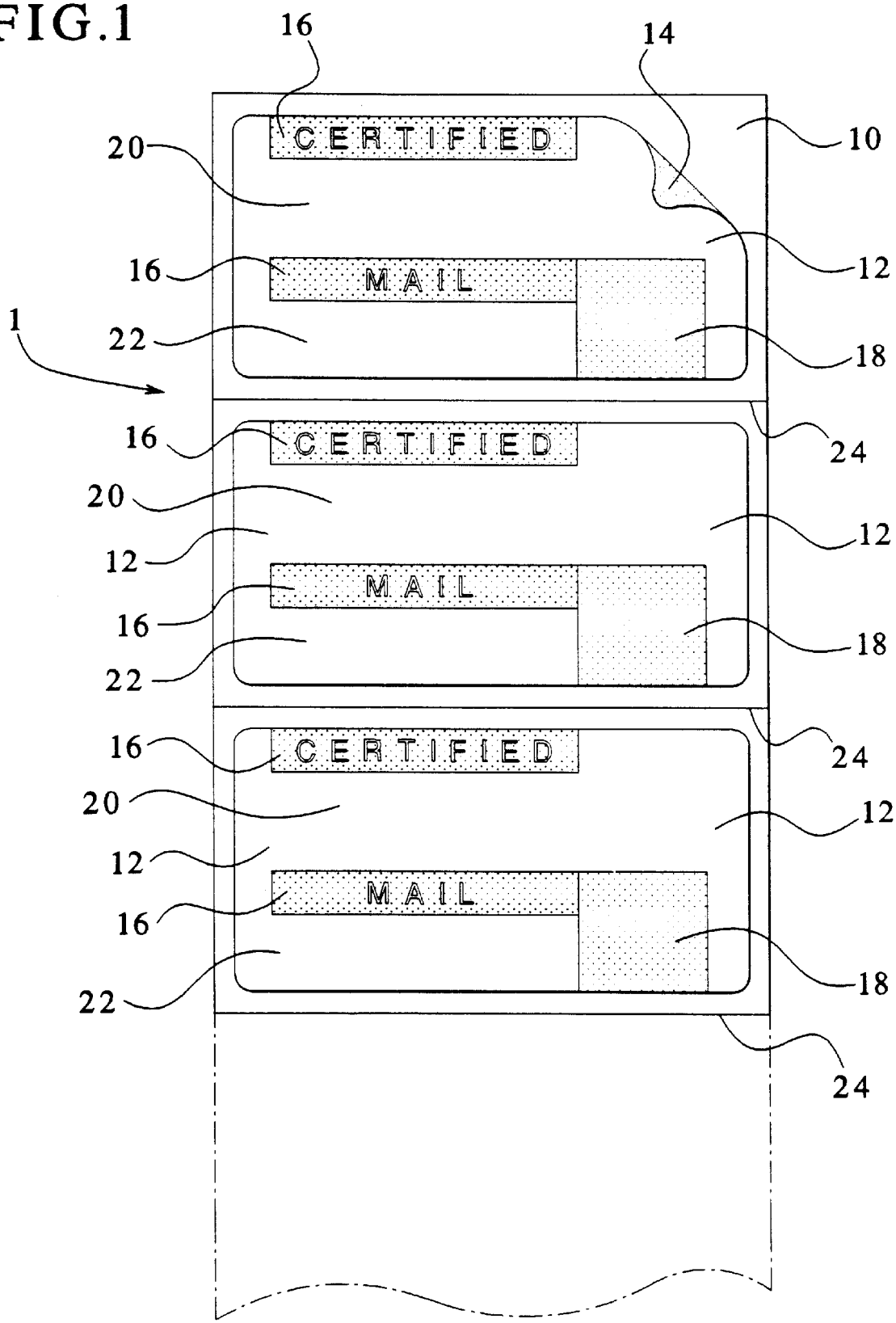
FIG. 1 illustrates a plan view of an embodiment of a continuous special service label assembly of the present invention.

Referring now to FIG. 1, an assembly 1 of the present invention is illustrated. The assembly 1 includes a backing layer 10 on which labels 12 are removably attached by an adhesive layer 14. Designation areas 16 are provided on the labels 12. The designation areas 16 may be distinctly colored from a remainder of the labels 12. For example, in a preferred embodiment, the label 12 is white and the designation areas 16 are green. Of course, other colors may be selected for the designation areas 16 for the particular special service mail required.

Also, incorporated on a front side of the label 12 is a taggant area 18. The taggant area 18 is a special area that fluoresces under long-wave ultraviolet light for detection by a suitably placed detector of the presence of a mailpiece requiring special services.

To use the assembly 1 of the present invention, the assembly 1 may be fed through a printer for printing of information onto one or more of the labels 12. To this end, a printable area 20 is provided on a front side of each of the labels 12. The printable area 20 provides sufficient space for printing of an article identification number, preferably machine readable, that specifically identifies the mailpiece on which the label 12 is to be attached. Another optional printable area 22 is provided on a front side of each of the labels 12 to print additional instructions or other information regarding the delivery of the mailpiece requiring special services. For example, for delivery by certified mail, often address correction is requested. In the printable area 22, the designation "Address Correction" may be printed to specify to the deliverer of the mailpiece and the recipient of the mailpiece that receipt for the delivery of the mailpiece has been requested by the sender, and furthermore, that a return postcard has been attached to the mailpiece.

The assembly 1 of the present invention may be printed by continuously feeding the same through a printer for printing in the printable areas 20, 22, as required, for the particular mailpiece or distribution of mailpieces. The invention is particularly beneficial for large distribution of mailpieces in which certified mail or other special service is required, and no return receipt is necessary. Accordingly, only an article identification number is required to be printed in the printable area 20. Therefore, the sequence of article identification numbers for a large mailing may be stored and tracked based on the number of labels printed. Following use of a series of labels 12 of the assembly 1, between adjacent labels 12, a perforated or score line 24 is provided for easy separation of the remainder of the labels 12 on the backer 10 from the used or printed labels 12 of the assembly 1.

Figure 2:
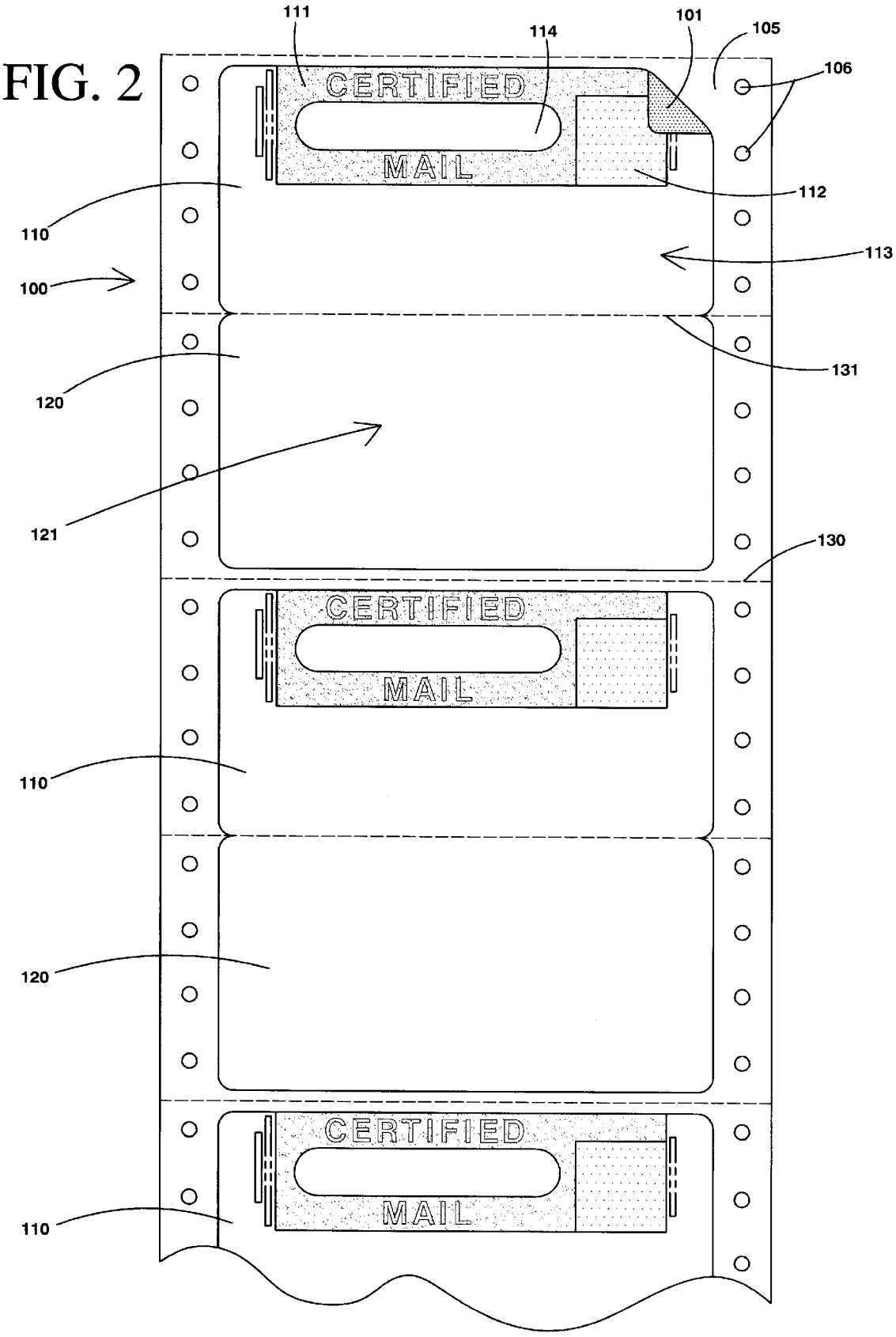
FIG. 2 illustrates a plan view of an alternative embodiment of a continuous special service label assembly of the present invention.

FIG. 2 offers an alternative embodiment of the present invention wherein the assembly 100 includes, generally, a backing sheet 105 to which a plurality of mailing labels 110 and auxiliary labels 120 are adhesively affixed. Such adhesion is provided by an adhesive layer 101 on the back of both the mailing labels 110 and the auxiliary labels 120. Each associated pair of the mailing labels 110 and the auxiliary labels 120 is detachably connected along a secondary score line 131.

Each mailing label 110 is provided with a designation area 111 which may be distinctly colored from a remainder of the mailing label 110. For example, in a preferred embodiment, the mailing label 110 is white and the designation area 111 is green (the color designation associated with certified mail service). Of course, other colors may be selected for the designation area 111 for the particular special mail service which is required.

Positioned within the designation area 111 is an article identification number area 114. The article identification number area 114 is imprinted with an article identification number, preferably machine readable, that specifically identifies the mailpiece on which the mailing label 110 is to be attached.

Also incorporated on the front side of the mailing label 110 is a taggant area 112. The taggant area 112 is a special area that fluoresces under long-wave ultraviolet light for detection by a suitably placed detector of the presence of a mailpiece requiring delivery by a service.

The mailing label 110 further includes a printable area 113 upon which additional instructions or other information regarding the delivery of the mailpiece requiring special services may be printed. For example, for delivery by certified mail, often return receipt is requested. In the printable area 113, the designation "Return Receipt Requested" may be printed to specify to the delivery person of the mailpiece and the recipient of the mailpiece that receipt for the delivery of the mailpiece has been requested by the sender and, furthermore, that a return postcard has been attached to the mailpiece.

The auxiliary label 120 is detachably connected to the mailing label 110 along a secondary score line 131. The auxiliary label 120 is intended to function in a variety of ways, such as a return address label, a customer receipt or some other type of customized label. In connection therewith, information may be imprinted in an auxiliary printable area 121 of the auxiliary label 120. For example, the auxiliary label 120 may include the return address of the sender of the mailpiece wherein the label 120 may be peeled off of the backing sheet 105, detached from its associated mailing label 110 along secondary score line 131 and affixed to a mailpiece as a conventional return address label separate and apart from the remainder of the mailing label 110. Again, the back side of the auxiliary label 120 preferably includes an adhesive layer 101 which allows the auxiliary label 120 to be removed from the backing sheet 105 and subsequently attached to the mailpiece.

As noted above, yet another use of the auxiliary label 120 is as a customer receipt. The auxiliary printable area 121 of the receipt may include, for example, such information as the article number, the addressee's address, the type of special mailing service used and the fees associated with such service. When used in this manner, the auxiliary label 120 need not be peeled away from the corresponding portion of the backing sheet 105 to which it is affixed. Rather, that portion of the backing sheet 105 remains affixed to the auxiliary label 120 as it is detached from both the rest of the mailing label 110 and the remainder of the backing sheet 105 along the primary score lines 130 and the secondary score lines 131.

In connection with the preferred method of use of the present invention, the assembly 100 may be fed through a printer for printing of variable information onto one or more of the mailing labels 110 and the associated auxiliary labels 120. In an embodiment, a plurality of holes 106 may be provided along edges of the assembly 100 which cooperate with standard printer wheel pins. The assembly 100 may then be printed by continuously feeding the same through a printer for printing in the printable area 113, the auxiliary printable area 121 and/or the article identification number area 114, as required, for the particular mailpiece or distribution of mailpieces.

The present invention is particularly beneficial for a large distribution of mailpieces in which certified mail or other special service is required, and no return receipt is necessary. Accordingly, only an article identification number is required to be printed in the article identification number area 114. Therefore, the sequence of article identification numbers for a large mailing may be stored and tracked based on the number of labels printed.

After the mailing label 110 and the associated auxiliary label 120 are imprinted with the requisite information, the labels 110, 120 may be removed from the backing sheet 105. Specifically, the mailing label 110 is peeled away from the backing sheet 105 and detached from its associated auxiliary label 120 along the secondary score line 131 whereupon the mailing label 110 may then be affixed to the mailpiece. Thereafter, if the auxiliary label 120 is to serve as a return address label, it is also peeled away from the backing sheet 105 and affixed to the mailpiece as a return address label. Alternatively, if the auxiliary label 120 is to serve as a customer receipt, it is not peeled away from the backing sheet 105. Rather, it is detached from a remainder of the backing sheet 105 along with its corresponding portion of the backing sheet 105 along the primary score lines 130 and the secondary score lines 131. Such receipt may then be retained by the sender of the mailpiece for record keeping purposes.

It is, of course, generally known and understood by those having ordinary skill in the art how to print and arrange necessary information on the auxiliary label 120 depending on the particular application for which the auxiliary label 120 is used. Therefore, the specific information on the auxiliary label 120 has not been shown in the figures nor has each option for the use of the auxiliary label 120. It should further be understood that the auxiliary label 120 may be used, as well, for other purposes associated with the delivery of the mailpiece by a special service as is necessary for a particular application.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A continuous assembly comprising:

a backer having a first width;

a plurality of labels formed from a single layer and removably secured to the backer wherein each of the plurality of labels is attached to the backer in only a single row and further wherein each of the plurality of labels has a second width between a first side and a second side defining a maximum width of each of the plurality of labels wherein the sides of adjacent labels are co-linearly aligned on the backer in the single row wherein the first width is greater than the second width such that the backer extends from each of the sides of each of the plurality of labels and further wherein each of the plurality of labels is separated by a first line defined by perforations extending along the first width of the backer, and further wherein each of the plurality of labels includes a mailing portion and an auxiliary portion wherein the mailing portion and the auxiliary portion are alternately arranged in the single row and separated by a second line defined by perforations along the first width of the backer and the second width of each of the plurality of labels, the mailing portion indicative of a special service required for delivery of a mailpiece on which the mailing portion is secured following its removal from the backer along the second perforation line, the auxiliary portion having information printed on a front side thereof and detachable from the mailing portion along the second perforation line;

an adhesive on a back side of the plurality of labels between the backer and the plurality of labels; and identifying information on each mailing portion indicative of the special service required for delivery of the mailpiece wherein the identifying information is one of certified mail, registered mail, insured mail or return receipt for merchandise mail.

2. The continuous assembly of claim 1 further comprising:

a distinctly colored section on the mailing portion.

3. The continuous assembly of claim 1 further comprising:

a printable area on the mailing portion for printing an indicia thereon.

4. The continuous assembly of claim 1 further comprising:

a first printable area on the mailing portion for printing an indicia thereon; and a second printable area on the mailing portion for printing special instructions thereon wherein the first printable area is separated from the second printable area.

5. The continuous assembly of claim 4 further comprising:

a distinctly colored section on the mailing portion separating the first printable area from the second printable area.

6. The continuous assembly of claim 1 further comprising:

a plurality of primary tear lines, each of the plurality of primary tear lines extending through the backer and aligned to separate adjacently positioned labels wherein each of the plurality of labels is separately detachable from a remainder of the assembly together with an associated portion of the backer to which the label is removably secured.

7. The continuous assembly of claim 1 further comprising:

a plurality of secondary tear lines, each of the plurality of secondary tear lines extending through both the backer and one of the plurality of labels and aligned to separate the mailing portion from the auxiliary portion of the label wherein the auxiliary portion is separately detachable from the mailing portion together with an associated portion of the backer to which the auxiliary portion is removably secured.

8. A method for preparing mailpieces requiring delivery by a special service, the method comprising the steps of:

providing a backer having a first width;

providing a plurality of labels formed from a single layer and adhesively backed and removably secured to the backer wherein each of the plurality of labels is attached to the backer in only a single row and further wherein each of the plurality of labels has a second width between a first side and a second side defining a maximum width of each of the plurality of labels wherein the sides of adjacent labels are co-linearly aligned on the backer in the single row wherein the first width is greater than the second width such that the backer extends from each of the sides of each of the plurality of labels and further wherein each of the plurality of labels is separated by a first line defined by perforations extending along the first width of the backer, and further wherein each of the plurality of labels includes a mailing portion and an auxiliary portion wherein the mailing portion and the auxiliary portion are alternately arranged in the single row and separated by a second line defined by perforations along the first width of the backer and the second width of each of the plurality of labels, the mailing portion indicative of a special service required for the mailpiece, the auxiliary portion having auxiliary information printed thereon and detachable from the mailing portion, the mailing portion having identifying information required for delivery of the mailpiece wherein the identifying information is one of certified mail, registered mail, insured mail or return receipt for merchandise mail removing at least one mailing portion of the plurality of labels from the backer along the second perforation line; and attaching the mailing portion to a corresponding one of the mailpieces.

9. The method of claim 8 further comprising the steps of:

removing the auxiliary portion from the backer; and attaching the auxiliary portion to a corresponding one of the mailpieces as an addressee address label.

10. The method of claim 8 further comprising the steps of:

removing the auxiliary portion from the backer; and attaching the auxiliary portion to a corresponding one of the mailpieces as a return address label.

11. The method of claim 8 further comprising the steps of:

detaching the auxiliary portion from a remainder of the backer; and retaining the auxiliary portion for mailing verification purposes.

12. The method of claim 8 further comprising the step of:

providing a plurality of tear lines in the backer to facilitate detaching the auxiliary portion, together with the associated portion of the backer to which the auxiliary portion is removably secured, from the remainder of the backer.

13. The method of claim 8 further comprising the steps of:

providing a plurality of primary tear lines through the backer aligned to separate adjacently positioned labels; and providing a plurality of secondary tear lines, each secondary tear line extending through both the backer and one of the labels and aligned to separate the mailing portion from the auxiliary portion of the label.

14. The method of claim 8 further comprising the step of:

printing an identifier on the mailing portion corresponding to a specific one of the mailpieces.

15. The method of claim 8 further comprising the step of:

providing an area on the mailing portion that is distinctly colored from a remainder of the mailing portion.

16. The method of claim 8 further comprising the step of:

printing an indicia on a printable area on the mailing portion of the plurality of labels.

17. The method of claim 8 further comprising the steps of:

printing an indicia on a first printable area on the mailing portion; and printing special instructions on a second printable area on the mailing portion of the plurality of labels wherein the first printable area is separated from the second printable area.

18. The continuous assembly of claim 1 further comprising:

a taggant area capable of fluorescence located within the mailing portion of each of the plurality of labels.

19. A continuous assembly comprising:

a backer having a first width;

a plurality of labels formed from a single layer and removably secured to the backer wherein each of the plurality of labels is attached to the backer in only a single row and further wherein each of the plurality of labels has a second width between a first side and a second side defining a maximum width of each of the plurality of labels wherein the sides of adjacent labels are co-linearly aligned on the backer in the single row wherein the first width is greater than the second width such that the backer extends from each of the sides of each of the plurality of labels and further wherein each of the plurality of labels is separated by a first line defined by perforations extending along the first width of the backer, and further wherein each of the plurality of labels includes a mailing portion and an auxiliary portion wherein the mailing portion and the auxiliary portion are alternately arranged in the single row and separated by a second line defined by perforations along the first width of the backer and the second width of each of the plurality of labels, the mailing portion indicative of a special service required for delivery of a mailpiece on which the mailing portion is secured following its removal from the backer along the second perforation line, the auxiliary portion having information printed on a front side thereof and detachable from the mailing portion along the second perforation line;

an adhesive on a back side of the plurality of labels between the backer and the plurality of labels;

identifying information on each mailing portion indicative of the special service required for delivery of the mailpiece wherein the identifying information is one of certified mail, registered mail, insured mail or return receipt for merchandise mail; and a machine readable code on the mailing portion.

20. The continuous assembly of claim 19 further comprising:

a distinctly colored section on the mailing portion.

21. The continuous assembly of claim 19 wherein the machine readable code is a barcode.

22. A method for preparing mailpieces requiring delivery by a special service, the method comprising the steps of:

providing a backer having a first width;

providing a plurality of labels formed from a single layer and removably secured to the backer wherein each of the plurality of labels is attached to the backer in only a single row and further wherein each of the plurality of labels has a second width between a first side and a second side defining a maximum width of each of the plurality of labels wherein the sides of adjacent labels are co-linearly aligned on the backer in the single row wherein the first width is greater than the second width such that the backer extends from each of the sides of each of the plurality of labels and further wherein each of the plurality of labels is separated by a first line defined by perforations extending along the first width of the backer, and further wherein each of the plurality of labels includes a mailing portion and an auxiliary portion wherein the mailing portion and the auxiliary portion are alternately arranged in the single row and separated by a second line defined by perforations along the first width of the backer and the second width of each of the plurality of labels, the mailing portion indicative of a special service required for delivery of a mailpiece on which the mailing portion is secured following its removal from the backer along the second perforation line, the auxiliary portion having information printed on a front side thereof and detachable from the mailing portion along the second perforation line;

providing an adhesive on a back side of the plurality of labels between the backer and the plurality of labels;

providing identifying information on each mailing portion indicative of the special service required for delivery of the mailpiece wherein the identifying information is one of certified mail, registered mail, insured mail or return receipt for merchandise mail;

providing a machine readable code on the mailing portion removing at least one of the plurality of labels from the backer; and attaching one of the plurality of labels to a corresponding one of the mailpieces.

23. The method of claim 22 further comprising the step of:

printing on each of the plurality of labels an identifier corresponding to a specific one of the mailpieces.

24. The method of claim 22 wherein the plurality of labels is equal in number to the mailpieces.

* * * * *